US010718546B2

(12) United States Patent
Ikeda et al.

(10) Patent No.: US 10,718,546 B2
(45) Date of Patent: Jul. 21, 2020

(54) AIR-CONDITIONING APPARATUS INDOOR UNIT

(71) Applicant: Mitsubishi Electric Corporation, Tokyo (JP)

(72) Inventors: Hisanori Ikeda, Tokyo (JP); Masayuki Oishi, Tokyo (JP); Shuhei Yokota, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 94 days.

(21) Appl. No.: 15/567,098

(22) PCT Filed: Aug. 6, 2015

(86) PCT No.: PCT/JP2015/072413
§ 371 (c)(1),
(2) Date: Oct. 17, 2017

(87) PCT Pub. No.: WO2017/022133
PCT Pub. Date: Feb. 9, 2017

(65) Prior Publication Data

US 2018/0094830 A1 Apr. 5, 2018

(51) Int. Cl.

| | |
|---|---|
| ***F24F 13/20*** | (2006.01) |
| ***F24F 1/0014*** | (2019.01) |
| ***F24F 13/14*** | (2006.01) |
| ***F24F 1/0007*** | (2019.01) |

(52) U.S. Cl.
CPC ..... *F24F 13/20* (2013.01); *F24F 1/0007* (2013.01); *F24F 1/0014* (2013.01); *F24F 13/14* (2013.01); *F24F 13/1413* (2013.01)

(58) Field of Classification Search
CPC ..... F24F 13/20; F24F 13/1413; F24F 1/0014; F24F 13/14; F24F 1/0007
See application file for complete search history.

(56) References Cited

U.S. PATENT DOCUMENTS 4,531,339 A * 7/1985 Tomaszewski ..... B44C 7/022 248/188.9
2006/0145577 A1* 7/2006 Daley ..... A47B 96/021 312/408
2016/0363328 A1 12/2016 Okamoto et al.

FOREIGN PATENT DOCUMENTS

CN 101201195 A * 6/2008
CN 203671856 U * 6/2014
CN 204026955 U * 12/2014
(Continued)

OTHER PUBLICATIONS

Matsuoka et al., Front Panel of Air Conditioner, Mar. 7, 1995, JPH0763367A, Whole Document (Year: 1995).*
(Continued)

*Primary Examiner* — Larry L Furdge
(74) *Attorney, Agent, or Firm* — Posz Law Group, PLC

(57) ABSTRACT

An air-conditioning apparatus indoor unit includes: a plastic design panel that includes a front panel part having a rectangular shape in front view and a flange part projecting toward a back surface from one longitudinal edge of the front panel part; and a reinforcement member that has a shape extending in the longitudinal direction of the front panel part across a middle part of the design panel and is fixed to the design panel so as to be in contact with a back surface of the front panel part and an inner surface of the flange part.

12 Claims, 6 Drawing Sheets

(56) References Cited

FOREIGN PATENT DOCUMENTS

| | | | | |
|---|---|---|---|---|
| JP | S63-055044 | U | | 4/1988 |
| JP | H05-099451 | A | | 4/1993 |
| JP | H06-004519 | U | | 1/1994 |
| JP | H0763367 | A | * | 3/1995 |
| JP | H10-038310 | A | | 2/1998 |
| JP | 2007-283863 | A | | 11/2007 |
| JP | 2008-121968 | A | | 5/2008 |
| JP | 2012-163307 | A | | 8/2012 |
| JP | 2014-089003 | A | | 5/2014 |
| JP | 2015-010775 | A | | 1/2015 |
| JP | 2015-124977 | A | | 7/2015 |
| JP | 2015-124978 | A | | 7/2015 |
| JP | 2015124978 | A | * | 7/2015 |
| KR | 20090009376 | U | * | 9/2009 |
| KR | 2020090009376 | U | | 9/2009 |
| WO | 2010/047442 | A1 | | 4/2010 |
| WO | 2013/108654 | A1 | | 7/2013 |

OTHER PUBLICATIONS

Meng et al., Air Conditioner Panel, Dec. 17, 2014, CN204026955U, Whole Document (Year: 2014).*

Chan et al., Air Conditioner, Sep. 17, 2009, KR20090009376U, Whole Document (Year: 2009).*

Weidong, Mirror Plane Front Panel Structure of Indoor Set of Air Conditioner, Jun. 18, 2008, CN101201195A, Whole Document (Year: 2008).*

Zhong et al., Connecting Structure for Upper Panel and Back Plate and Air Conditioner, May 25, 2014, CN203671856U, Whole Document (Year: 2014).*

Okamoto et al., Indoor Equipment, Jul. 6, 2015, JP2015124978A, Whole Document (Year: 2015).*

International Search Report of the International Searching Authority dated Oct. 27, 2015 for the corresponding International application No. PCT/JP2015/072413 (and English translation).

Extended European Search Report dated Mar. 1, 2018 issued in corresponding EP patent application No. 15893546.0.

Office Action dated Aug. 1, 2018 issued in corresponding AU patent application No. 2015405043.

Office Action dated Aug. 7, 2018 issued in corresponding JP patent application No. 2017-532348 (and English translation).

Office Action dated Feb. 7, 2019 issued in corresponding EP patent application No. 15893546.0.

Office action dated Jul. 3, 2019 issued in corresponding CN patent application No. 201580082050.1 (and English translation thereof).

Office Action dated Sep. 6, 2019 issued in corresponding in patent application No. 201747039776.

Office Action dated Apr. 14, 2020 issued in corresponding CN patent application No. 201580082050.1 (with English translation).

* cited by examiner

AIR-CONDITIONING APPARATUS INDOOR UNIT

CROSS REFERENCE TO RELATED APPLICATION

This application is a U.S. national stage application of PCT/JP2015/072413 filed on Aug. 6, 2015, the contents of which are incorporated herein by reference.

TECHNICAL FIELD

The present invention relates to an air-conditioning apparatus indoor unit that has a plastic design panel.

BACKGROUND ART

The sizes of air-conditioning apparatuses these days are getting larger year by year with an improvement in performance. As the sizes of the air-conditioning apparatuses are increased, the sizes of design panels provided, for example, on the front sides of indoor units are also increased.

Conventionally, indoor units have plastic design panels (for example, see Patent Literature 1). A design panel in Patent Literature 1 is pivoted about pivot arms provided upright at an upper part of a back surface thereof and is fixed to a front frame by engaging projections provided at a lower part on the back surface side.

CITATION LIST

Patent Literature

Patent Literature 1: Japanese Unexamined Patent Application Publication No. 2012-163307

SUMMARY OF INVENTION

Technical Problem

However, because the design panels are formed of plastic, they have low rigidity and tend to warp in the longitudinal direction. More specifically, in the design panels having a rectangular shape in front view, as that in Patent Literature 1, a middle part in the longitudinal direction is most susceptible to the influence of warping and has low rigidity.

Furthermore, the design panel is provided with the engaging projections with which the design panel is fixed to a base of the indoor unit, the engaging projections being provided at one end, the middle part, and the other end, in the longitudinal direction, of the lower part of the inner surface. In the design panel warped in the longitudinal direction, even when the engaging projections at both ends are engaged with corresponding receiving parts, the engaging projection at the middle part cannot be engaged with the corresponding receiving part, and hence, the middle part is separated. If the engaging projection at the middle part is forcibly inserted into the receiving part, the design panel is flexed, degrading the exterior design quality.

The present invention has been made to solve the above-described problems, and an object thereof is to provide an air-conditioning apparatus indoor unit having a rigid design panel with high design quality.

Solution to the Problem

An air-conditioning apparatus indoor unit of an embodiment of the present invention includes: a plastic design panel that includes a front panel part having a rectangular shape in front view and a flange part projecting toward a back surface from one longitudinal edge of the front panel part; and a reinforcement member that has a shape extending in the longitudinal direction of the front panel part across a middle part of the design panel and is fixed to the design panel so as to be in contact with a back surface of the front panel part and an inner surface of the flange part.

ADVANTAGEOUS EFFECTS OF INVENTION

In an embodiment of the present invention, because the reinforcement member having a shape extending in the longitudinal direction across the middle part of the design panel is fixed to the design panel so as to be in contact with the back surface of the front panel part and the inner surface of the flange part, it is possible to increase the rigidity of the design panel and to improve the exterior design quality of the design panel and the indoor unit.

DESCRIPTION OF EMBODIMENTS

Embodiment 1

Figure 1:
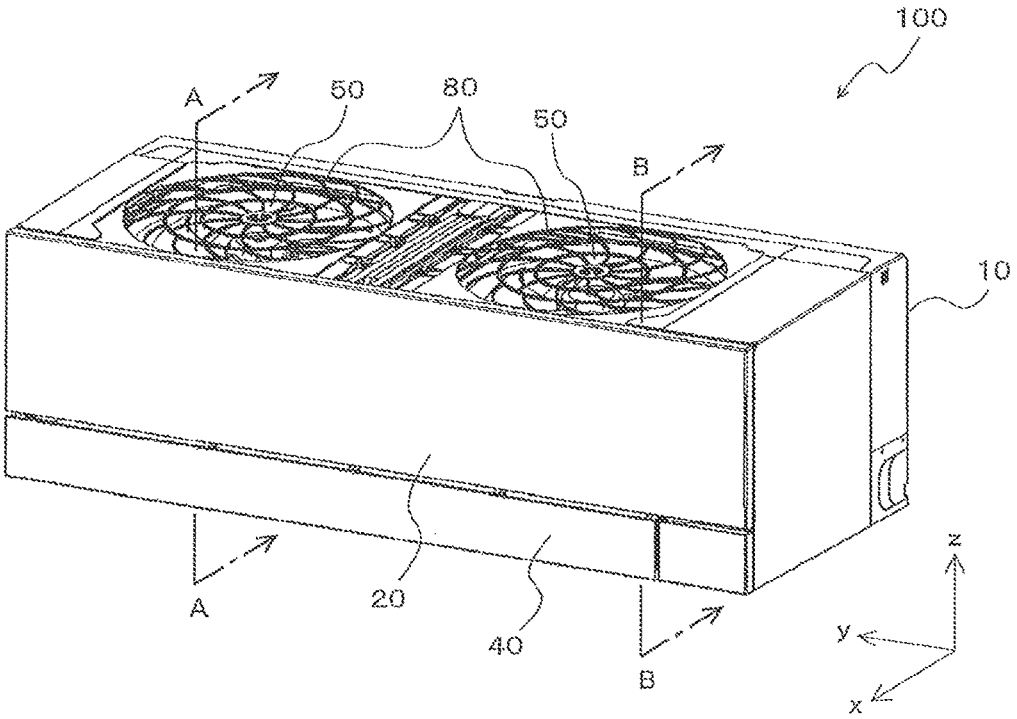
FIG. 1 is a perspective view showing the exterior of an air-conditioning conditioning apparatus indoor unit according to Embodiment 1 of the present invention.
Figure 2:
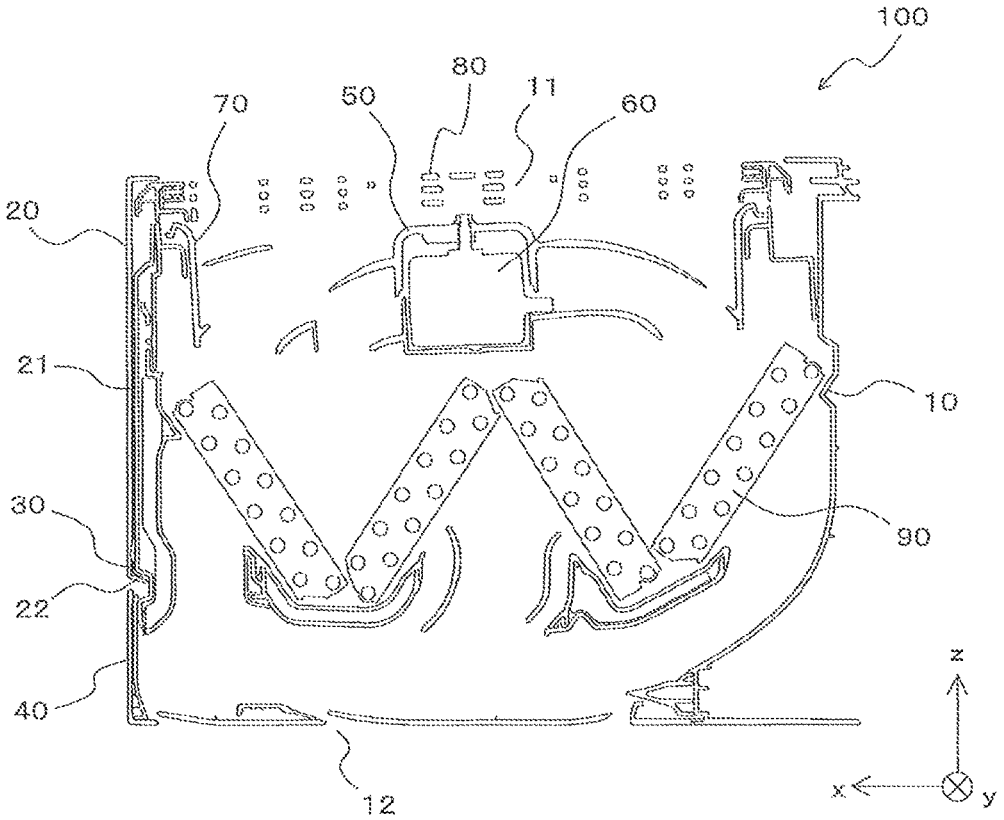
FIG. 2 is a schematic sectional view of the indoor unit, taken along line A-A in FIG. 1.

FIG. 1 is a perspective view showing the exterior of an air-conditioning conditioning apparatus indoor unit 100 according to Embodiment 1 of the present invention. FIG. 2 is a schematic sectional view of the indoor unit 100 taken along line A-A in FIG. 1. The configuration of the indoor unit 100 will be described with reference to FIGS. 1 and 2. Herein, the positive side of the x-axis shown in FIGS. 1 and 2 is defined as the front side of the indoor unit 100.

Furthermore, because the indoor unit 100 has a rectangular shape in front view, the y-axis direction is defined as the longitudinal direction, and the z-axis direction is defined as the transverse direction.

The indoor unit 100 supplies air-conditioned air to an air-conditioning area, such as the inside of a room, by using a refrigeration cycle, in which refrigerant is circulated. The indoor unit 100 is, for example, a wall-mounted indoor unit to be mounted on a wall inside a room and includes a base 10, a design panel 20, a reinforcement member 30, a wind-direction adjusting plate 40, propeller fans 50, fan motors 60, bell mouths 70, a filter assembly 80, and a heat exchanger 90.

The base 10, which constitutes a casing of the indoor unit 100, has an air inlet 11, through which indoor air is taken in, and an air outlet 12 through which air-conditioned air is supplied to the air-conditioning area. The air inlet 11 is provided, in the form of an opening, at the upper part of the base 10. The air outlet 12 is provided, in the form of an opening, at the lower part of the base 10, on the front side. Furthermore, an air passage communicating between the air inlet 11 and the air outlet 12 is formed inside the base 10.

The design panel 20 is provided on the front side of the indoor unit 100 and has a rectangular shape in front view. Specifically, the design panel 20 has a rectangular shape in which the edges extending in the longitudinal direction are longer than the edges extending in the transverse direction. The reinforcement member 30 is fixed to the design panel 20 to increase the rigidity of the design panel 20.

The wind-direction adjusting plate 40 is provided below the design panel 20 so as to be in flush with the design panel 20. The wind-direction adjusting plate 40 is pivoted about the upper part, which is located on the positive side of the z-axis, and serves to adjust the angle of the air blown out of the air outlet 12.

The propeller fans 50 are formed of, for example, axial-flow fans, mixed-flow fans, or the like, are provided in an air passage communicating between the air inlet 11 and the air outlet 12, and are accommodated in the base 10. More specifically, the propeller fans 50 are provided downstream of the air inlet 11 and upstream of the heat exchanger 90. The propeller fans 50 take in the indoor air from the air inlet 11 and discharge the air-conditioned air from the air outlet 12. The fan motors 60 are actuated by, for example, an inverter circuit and drive the propeller fans 50.

The bell mouths 70 are provided so as to surround the propeller fans 50 and guide the indoor air into the base 10. The filter assembly 80 serves to remove dust and the like in the indoor air. The heat exchanger 90 is provided in the air passage between the propeller fans 50 and the air outlet 12 and produces air-conditioned air by making the refrigerant and the indoor air exchange heat.

Figure 3:
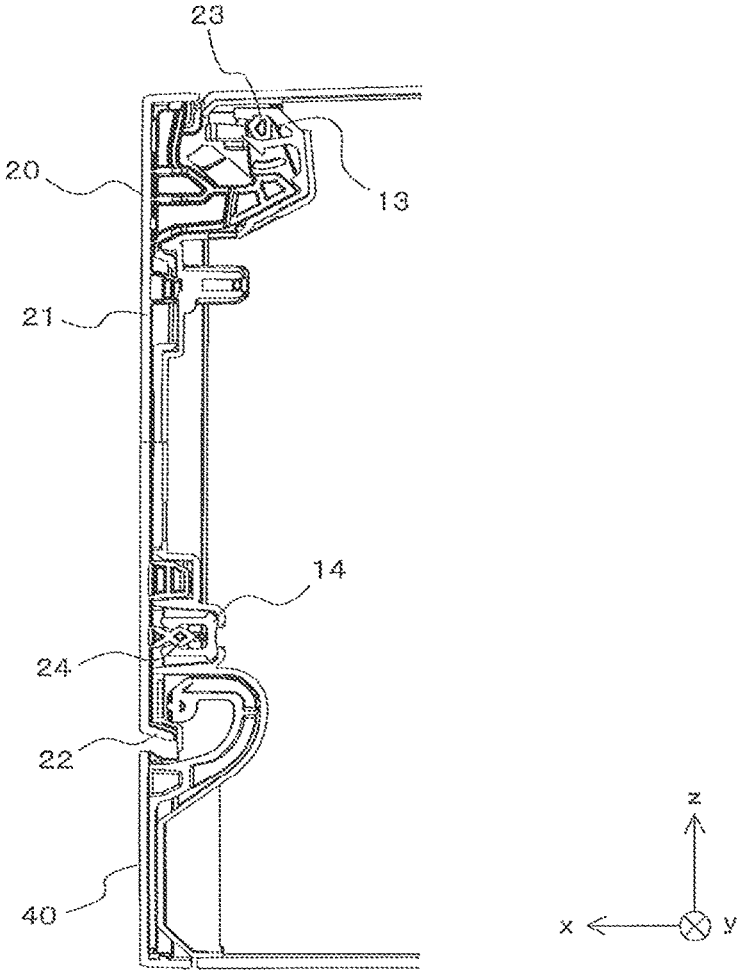
FIG. 3 is a schematic sectional view of a design panel and a wind-direction adjusting plate, taken along line B-B in FIG. 1.

FIG. 3 is a schematic sectional view of the design panel 20 and the wind-direction adjusting plate 40 taken along line B-B. The detailed configuration of the design panel 20 and the wind-direction adjusting plate 40 of the indoor unit 100 will be described on the basis of FIG. 3.

The design panel 20 includes a front panel part 21 which has a rectangular shape in front view and is formed of plastic, and a flange part 22, which projects toward the back surface from one longitudinal edge of the front panel part 21. The design panel 20 also includes a plurality of shafts 23 provided at the upper part of the back surface and a plurality of engaging projections 24 provided at the lower part of the back surface. The front panel part 21, the flange part 22, the plurality of shafts 23, and the plurality of engaging projections 24 are integrally formed of plastic.

The plurality of shafts 23 are each pivotably engaged with corresponding one of a plurality of pivot support parts 13 provided on the base 10. Furthermore, the plurality of engaging projections 24 are each engaged with corresponding one of a plurality of engaging-projection receiving parts 14 provided on the base 10.

Figure 4:
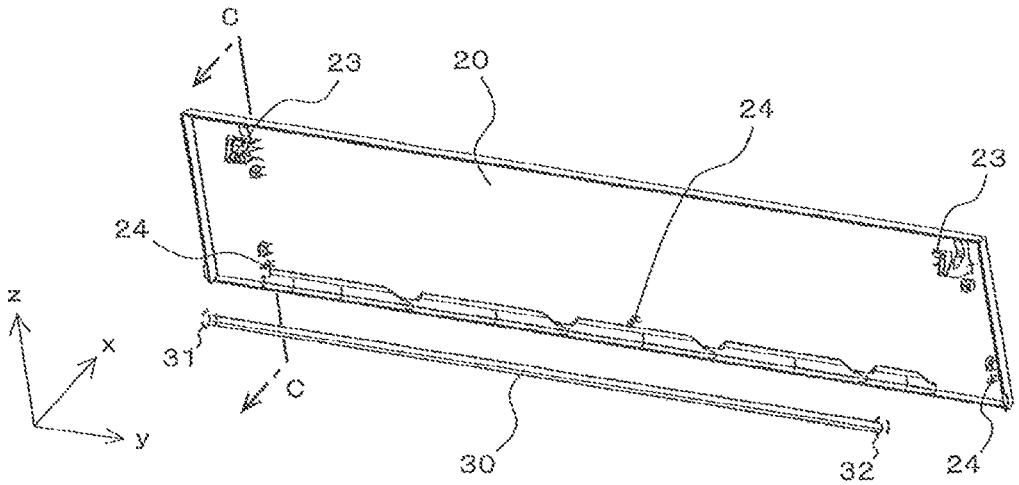
FIG. 4 is an exploded perspective view showing a back surface before a reinforcement member is fixed to the design panel in FIG. 1.

As shown in FIG. 4 or the like described below, the indoor unit 100 according to Embodiment 1 has two shafts 23 and three engaging projections 24, and corresponding two pivot support parts 13 and three engaging-projection receiving parts 14. The three engaging projections 24 and the three engaging-projection receiving parts 14 are arranged side-by-side in the longitudinal direction.

Note that it is desirable the number of the shafts 23 and the pivot support parts 13 be changed as appropriate according to the longitudinal length of the design panel 20 or the like to enable smooth pivoting of the design panel 20. Furthermore, it is also desirable that the number of the engaging projections 24 and the engaging-projection receiving parts 14 be changed as appropriate according to the longitudinal length of the design panel 20 or the like to ensure a stably fixed state of the design panel 20. In other words, the indoor unit 100 may have three or more engaging projections 24 and engaging-projection receiving parts 14.

The design panel 20 is attached to the base 10 by engaging the shafts 23 with the corresponding pivot support parts 13. The design panel 20 is fixed to the base 10 by engaging the engaging projections 24 with the corresponding engaging-projection receiving parts 14. The design panel 20 can be detached from the base 10 by disengaging the engaging projections 24 from the engaging-projection receiving parts 14 and disengaging the shafts 23 from the pivot support parts 13.

In other words, the design panel 20 can be attached to and detached from the base 10. Furthermore, as a result of the shafts 23 being engaged with the pivot support parts 13, the design panel 20 becomes capable of pivoting about the upper part, that is, becomes capable of being opened and closed via the upper part.

Figure 5:
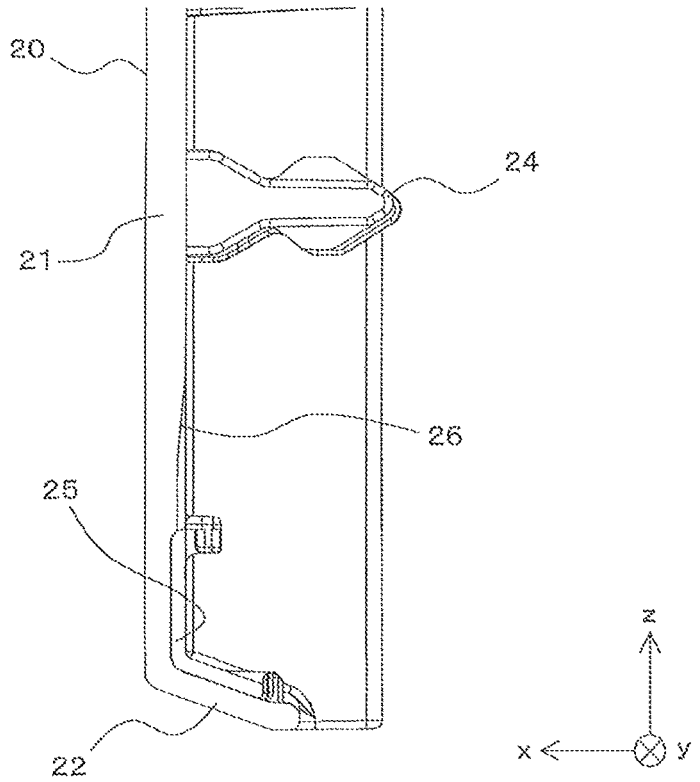
FIG. 5 is a partial schematic sectional view showing a flange part side in the section taken along line C-C in FIG. 4.
Figure 6:
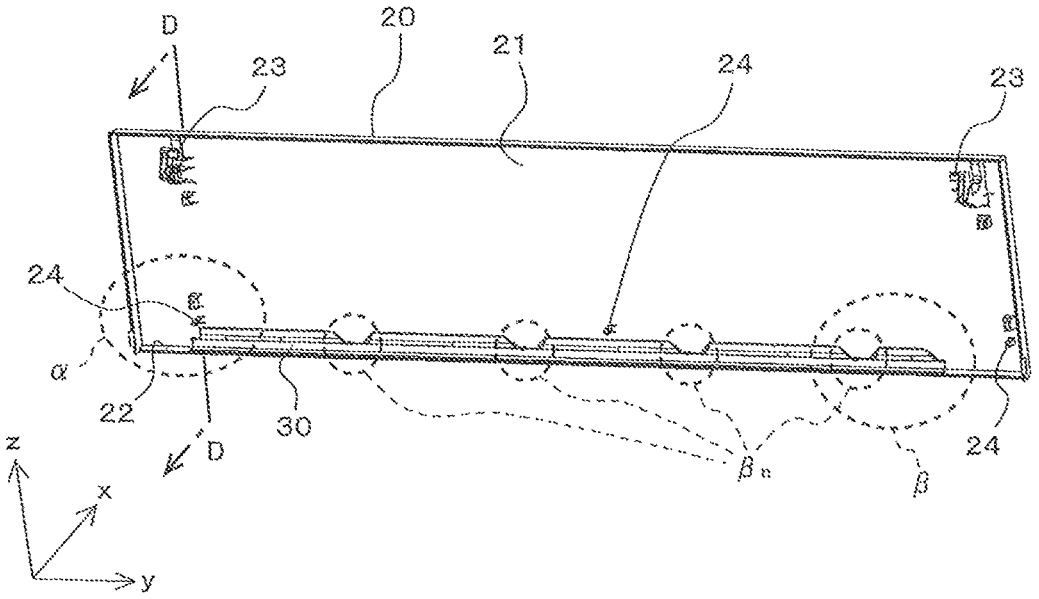
FIG. 6 is a back-surface perspective view showing a state after the reinforcement member is fixed to the design panel in FIG. 1.
Figure 7:
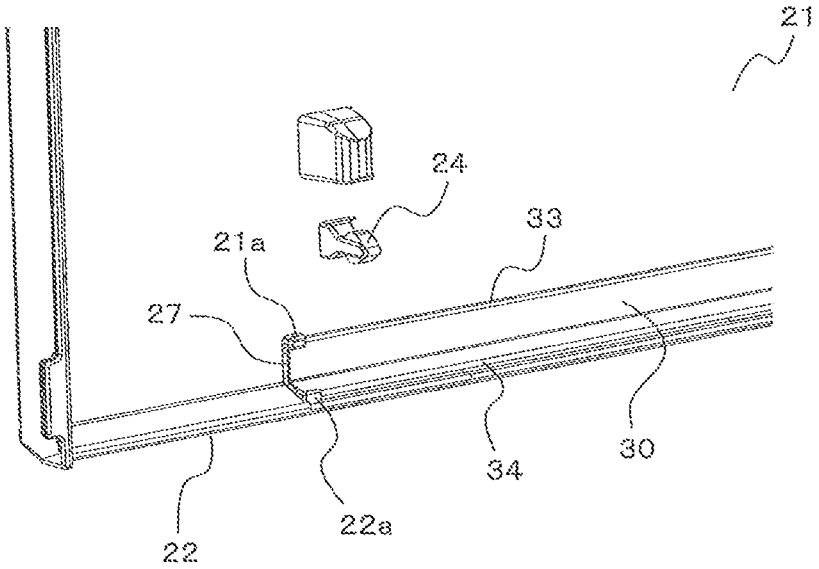
FIG. 7 is an enlarged view of a peripheral portion of one end of he reinforcement member shown in FIG. 6.
Figure 8:
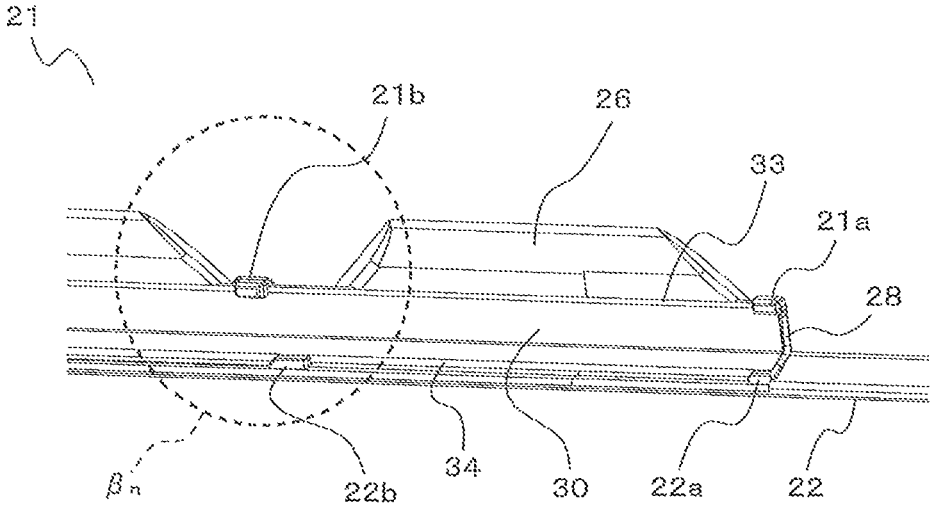
FIG. 8 is an enlarged view of a peripheral portion of another end of the reinforcement member shown in FIG. 6 when the design panel has another-end touch-preventing wall.
Figure 9:
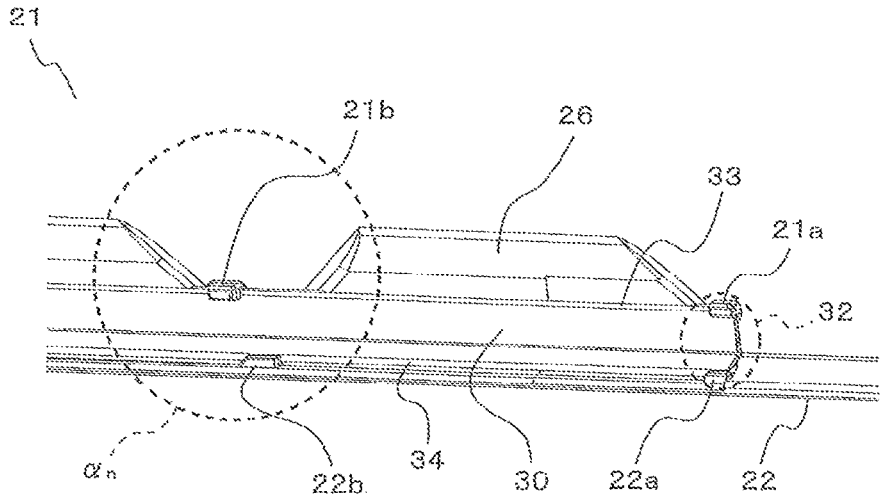
FIG. 9 is an enlarged view of the peripheral portion of another end of the reinforcement member shown in FIG. 6 when the design panel does not have the other-end touch-preventing wall.

FIG. 4 is an exploded perspective view showing the back surface before the reinforcement member 30 is fixed to the design panel 20. FIG. 5 is a partial schematic sectional view showing a flange part 22 side in the section taken along line C-C in FIG. 4. FIG. 6 is a back-surface perspective view showing a state after the reinforcement member 30 is fixed to the design panel 20. FIG. 7 is an enlarged view of a peripheral portion $\alpha$ of one end 31 of the reinforcement member 30 shown in FIG. 6. FIG. 8 is an enlarged view of a peripheral portion $\beta$ of another end 32 of the reinforcement member 30 shown in FIG. 6 when the design panel 20 has another-end touch-preventing wall 28. FIG. 9 is an enlarged view of the peripheral portion $\beta$ of the other end 32 of the reinforcement member 30 shown in FIG. 6 when the design panel 20 does not have the other-end touch-preventing wall 28. Referring to FIGS. 4 to 9, a process of fixing the reinforcement member 30 to the design panel 20 and the configurations that function when the reinforcement member 30 is fixed will be described in detail.

The reinforcement member 30 has a shape extending in the longitudinal direction, across the middle part of the front panel part 21. The reinforcement member 30 is disposed at the lower part of the back surface of the design panel 20, as shown in FIG. 4, and is attached to the design panel 20 so as to be in contact with the back surface of the front panel part 21 and the inner surface of the flange part 22, as shown in FIG. 6. Furthermore, the reinforcement member 30 is fixed so as to be in contact with the back surface of the front panel part 21 and the inner surface of the flange part 22, over the overall area in the longitudinal direction. Herein, the middle part refers to the area including one central engaging projection 24 among the three engaging projections 24, and two central peripheral portions $\beta_n$ among the peripheral portions $\beta_n$ (described below).

The reinforcement member 30 is made of metal and is formed in an L shape in section corresponding to the angle formed between the back surface of the front panel part 21 and the inner surface of the flange part 22. By making the reinforcement member 30 have an L-shaped section in this manner, the rigidity of the design panel 20 against longitudinal warping is increased.

Meanwhile, the design panel 20, in a state in which the reinforcement member 30 is fixed, may be removed and washed with water by a user. Hence, in Embodiment 1, stainless steel, which is a rust-resistant material, is employed as the material of the reinforcement member 30. Furthermore, the thickness of the stainless steel material to be used for the reinforcement member 30 is set to 0.6 mm, by taking into consideration the weight, rigidity, etc.

As shown in FIG. 5, the design panel 20 is provided with a recessed groove part 25 for receiving a portion of the reinforcement member 30 in at least one of the back surface of the front panel part 21 and the inner surface of the flange part 22. The provision of the groove part 25 in the design panel 20 partially reduces the thickness of the design panel 20, reducing the rigidity of the design panel 20 itself.

However, in the case where the groove part 25 is provided in the design panel 20, the inner space of the indoor unit 100 is efficiently utilized to accommodate the reinforcement member 30. Furthermore, because the groove part 25 serves as an element for visually clearly indicating the fixing position for the reinforcement member 30 and enables the reinforcement member 30 to be smoothly fitted to a position around the groove part 25, the operation of fixing the reinforcement member 30 can be simplified. Even though the rigidity of the design panel 20 itself is slightly reduced by the provision of the groove part 25, because the indoor unit 100 has the reinforcement member 30 extending in the longitudinal direction, the rigidity of the design panel 20 can be sufficiently increased.

Note that, although FIG. 5 shows an example groove part 25 that has such a size that it can accommodate a portion of the reinforcement member 30, the groove part 25 may have such a depth that all the peripheral end faces of the reinforcement member 30 are not exposed. This configuration prevents an end user from touching the edges of the reinforcement member 30, which is made of metal, when he or she opens, closes, or removes the design panel 20, it is possible to improve the safety.

The design panel 20 also has a slope part 26 that makes the step between the inner surface of the front panel part 21 and the bottom surface of the groove part 25 less steep. In the case where the slope part 26 is provided, a drastic change in the thickness of the plastic is prevented, and hence, it is possible to avoid a situation in which a part of the periphery extending along with the longitudinal direction of the groove part 25 is viewed from the front side.

However, the design panel 20 may be formed to have a constant thickness, without providing the groove part 25 or the slope part 26. If the thickness is not changed, the rigidity of the design panel 20 can be supplemented by the reinforcement member 30 while maintaining the rigidity of the plastic design panel 20 itself, and thus, it is possible to more effectively prevent warping.

As clearly shown in FIGS. 7 and 8, the front panel part 21 has, on the back surface thereof, two panel-side restricting-and-fixing claws 21*a* that support the one end 31 and the other end 32 of the reinforcement member 30 and restrict the position of the reinforcement member 30. The flange part 22 has, on the inner surface thereof, two flange-side restricting-and-fixing claws 22*a*, which support the one end 31 and the other end 32 of the reinforcement member 30 and restrict the position of the reinforcement member 30.

Furthermore, the front panel part 21 has, on the back surface thereof, at least one panel-side fixing claw 21*b* that supports an edge 33 of the reinforcement member 30 on the front panel part 21 side. The flange part 22 has, on the inner surface thereof, at least one flange-side fixing claw 22*b* that supports an edge 34 of the reinforcement member 30 on the flange part 22 side.

In other words, the reinforcement member 30 is fixed by the two panel-side restricting-and-fixing claws 21*a* and at least one panel-side fixing claw 21*b*, which are provided on the back surface of the design panel 20 and the two flange-side restricting-and-fixing claws 22*a* and at least one flange-side fixing claw 22*b*, which are provided on the inner surface of the flange part 22.

The peripheral portion $\beta_n$ of the panel-side fixing claw 21*b* and the flange-side fixing claw 22*b* shown in FIG. 8 corresponds to one of the peripheral portions $\beta_n$ in FIG. 6. Specifically, the design panel 20 according to Embodiment 1 has four panel-side fixing claws 21*b* and four flange-side fixing claws 22*b*.

Note that the number of the panel-side fixing claws 21*b* and the flange-side fixing claws 22*b* may be increased or decreased as appropriate according to the longitudinal length of the design panel 20. In addition, the positional relationship between the panel-side fixing claws 21*b* and the flange-side fixing claws 22*b* is not limited to the example in FIG. 8. Specifically, for example, the panel-side fixing claws 21*b* and the flange-side fixing claws 22*b* may be arranged side-by-side in the transverse direction, which equals the z-axis direction, or the relative positions of the panel-side fixing claws 21*b* and the flange-side fixing claws 22*b* in the longitudinal direction may be switched.

Furthermore, as shown in FIGS. 7 and 8, the design panel 20 has a one-end touch-preventing wall 27 provided at a position adjacent to the one end 31 of the reinforcement member 30 so as to project and extend over the back surface of the front panel part 21 and the inner surface of the flange part 22, and the other-end touch-preventing wall 28 provided at a position adjacent to the other end 32 of the reinforcement member 30 so as to project and extend over the back surface of the front panel part 21 and the inner surface of the flange part 22.

In Embodiment 1, the one-end touch-preventing wall 27 is formed so as to connect the panel-side restricting-and-fixing claw 21*a* and the flange-side restricting-and-fixing claw 22*a* at the one end 31 of the reinforcement member 30, and the other-end touch-preventing wall 28 is formed so as to connect the panel-side restricting-and-fixing claw 21*a* and the flange-side restricting-and-fixing claw 22*a* at the other end 32 of the reinforcement member 30.

The one-end touch-preventing wall 27 and the other-end touch-preventing wall 28 are formed according to the sectional shape of the reinforcement member 30. Hence, in Embodiment 1, the one-end touch-preventing wall 27 and the other-end touch-preventing wall 28 are formed in an L shape, according to the L-shaped section of the reinforcement member 30. The inner surface of the one-end touch-preventing wall 27 faces one L-shaped transverse end face of the reinforcement member 30, and the inner surface of the other-end touch-preventing wall 28 faces the other L-shaped transverse end face of the reinforcement member 30.

Herein, the distance between the transverse end face of the reinforcement member 30 and the one-end touch-preventing wall 27 or the other-end touch-preventing wall 28 is determined such that the distance between the inner surface of the one-end touch-preventing wall 27 and the inner surface of the other-end touch-preventing wall 28 is minimum but is not shorter than the longitudinal length of the reinforcement member 30, taking into consideration the longitudinal dimensional variations of the reinforcement member 30, which is made of metal, and the design panel 20, which is made of plastic. The reason for this is that, if the relationship between the distance between the inner surface of the one-end touch-preventing wall 27 and the inner surface of the other-end touch-preventing wall 28 and the longitudinal length of the reinforcement member 30 is reversed, the reinforcement member 30 cannot be attached. Another reason is that the smaller the distance between the transverse end face of the reinforcement member 30 and the one-end touch-preventing wall 27 or the other-end touch-preventing wall 28 is, the more the risk of a user's hand touching the edge of the one end 31 or the other end 32 can be reduced.

In other words, when the one-end touch-preventing wall 27 and the other-end touch-preventing wall 28 are provided on the design panel 20, the edges of the one end 31 and the other end 32 are prevented from being exposed. As a result, a user does not touch the edges of the one end 31 and the other end 32, and thus, the safety can be improved.

In Embodiment 1, the distance between the one transverse end face of the reinforcement member 30 and the one-end touch-preventing wall 27 opposite thereto and the distance between the other transverse end face of the reinforcement member 30 and the other-end touch-preventing wall 28 opposite thereto are both set to 0.5 mm.

Note that, as shown in FIG. 9, the design panel 20 does not need to have the other-end touch-preventing wall 28, and similarly, does not need to have the one-end touch-preventing wall 27. Even in such a configuration, as shown in FIG. 9, because the panel-side restricting-and-fixing claws 21*a* and the flange-side restricting-and-fixing claws 22*a* are configured to be adjacent to portions of the one and the other transverse end faces of the reinforcement member 30 and to support the one end 31 and the other end 32, it is possible to inhibit a user from touching the edges and to enable accurate positioning of the reinforcement member 30.

The reinforcement member 30 is formed such that the longitudinal length thereof is 70% or more of the longitudinal length of the design panel 20. Embodiment 1 shows an example in which the reinforcement member 30 having a longitudinal length of 750 mm is fixed to the design panel 20 having a longitudinal length of 890 mm. In this case, the longitudinal length of the reinforcement member 30 is 84% of the longitudinal length of the design panel 20.

Figure 10:
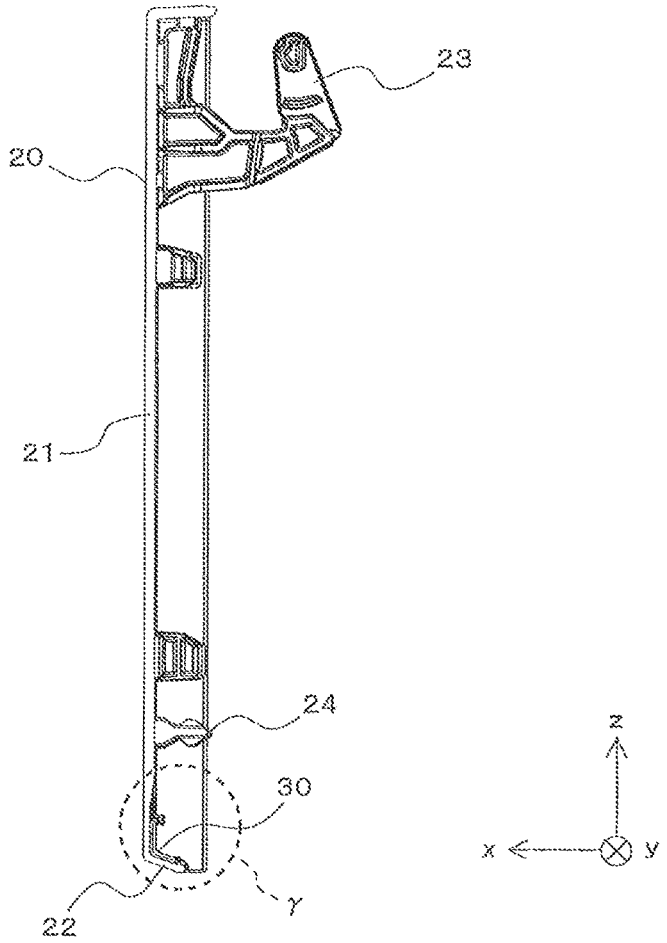
FIG. 10 is a schematic sectional view of the design panel and the reinforcement member taken along line D-D in FIG. 6.
Figure 11:
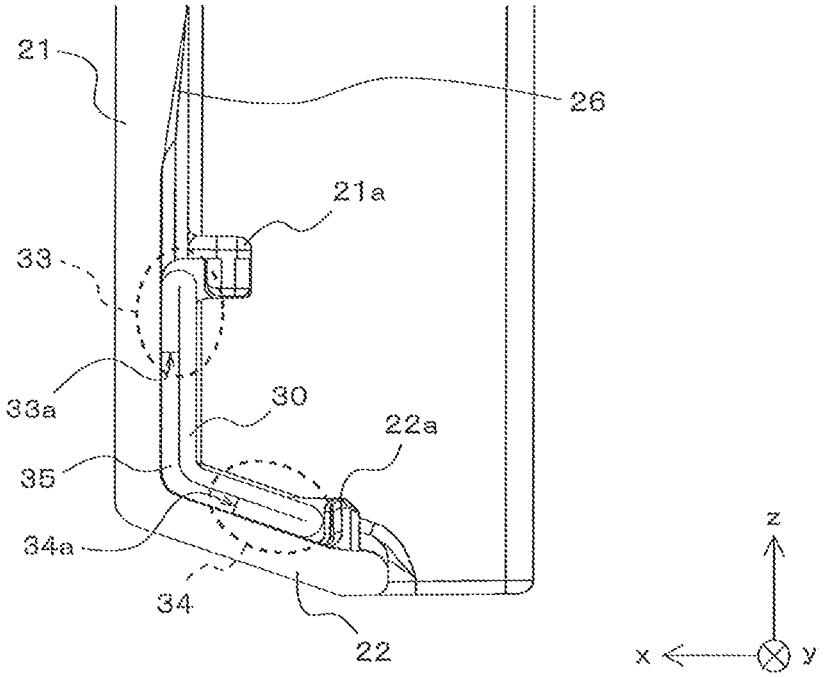
FIG. 11 is an enlarged view of a peripheral portion of the reinforcement member shown in FIG. 10.

FIG. 10 is a schematic sectional view of the design panel, taken along line D-D in FIG. 6. FIG. 11 is an enlarged view of a peripheral portion γ of the reinforcement member 30 shown in FIG. 10.

A user opens, closes, or removes the design panel 20 when cleaning the design panel 20 or cleaning a prefilter (not shown) of the indoor unit 100. Hence, the user's hand may touch the edge 33 and the edge 34. As has been described above, because the reinforcement member 30 is made of metal, edges are formed at the periphery if no processing is performed.

Hence, the reinforcement member 30 according to Embodiment 1 is subjected to processing for ensuring the safety. More specifically, as shown in FIG. 10, the edge 33 on the front panel part 21 side and the edge 34 on the flange part 22 side of the reinforcement member 30 are subjected to contact-bending processing such that the peripheral edges are not exposed. The edge 33 on the front panel part 21 side is bent toward the front panel part 21 such that the edge side is in contact with the back surface of the front panel part 21. Furthermore, the edge 34 on the flange part 22 side is bent toward the flange part 22 such that the edge side is in contact with the inner surface of the flange part 22. The contact-bending processing may be performed on one of the edge 33 on the front panel part 21 side and the edge 34 on the flange part 22 side.

With the reinforcement member 30 in which the contact-bending processing is performed on at least one of the edge 33 on the front panel part 21 side and the edge 34 on the flange part 22 side in this way, the safety can be improved, and the rigidity of the reinforcement member 30 can be increased.

Although FIG. 11 shows an example case where a predetermined distance is provided between an end face 33*a* of the edge 33 and an end face 34*a* of the edge 34 that are folded back by contact-bending processing, so that a space 35 continuous in the longitudinal direction is provided in the space surrounded by the back surface of the front panel part 21, the inner surface of the flange part 22, and the reinforcement member 30, the configuration is not limited thereto. Specifically, the distance between the end face 33*a* and the end face 34*a*, that is, the lengths by which the edges are bent in the contact-bending processing may be changed as appropriate according to the rigidity needed by the reinforcement member 30, the function of a processing machine, or the like, and, for example, it is possible not to provide the space 35 by leaving no distance between the end face 33*a* and the end face 34*a*.

Furthermore, although it may be considered that, when the groove part 25 is formed such that the overall peripheral end faces of the reinforcement member 30 are not exposed, the contact-bending processing is unnecessary from the standpoint of safety, even in such a case, the contact-bending processing may be performed on at least one of the edge 33 on the front panel part 21 side and the edge 34 on the flange part 22 side with the intention of increasing the rigidity.

As has been described above, in the air-conditioning apparatus indoor unit 100 according to Embodiment 1, because the reinforcement member 30 that has a shape extending in the longitudinal direction across the middle part of the design panel 20 is fixed to the design panel 20 so as to be in contact with the back surface of the front panel part 21 and the inner surface of the flange part 22, it is possible to increase the rigidity of the design panel 20 and to improve the exterior design quality of the design panel 20 and the indoor unit 100.

Furthermore, because the reinforcement member 30 has rigidity enough to prevent warping, on the flange part 22 side, of the design panel 20, the design panel 20 provided with the reinforcement member 30 is not separated at the middle part and, thus, can be maintained in an unwarped state. Accordingly, with the indoor unit 100, it is possible to maintain a state in which the engaging projection 24 at the middle part is engaged with the corresponding engaging-projection receiving part 14 only by engaging the engaging projections 24 at one end and the other end of the design panel 20 with the corresponding receiving parts. In other words, by mounting the reinforcement member 30, separation of the middle part of the design panel 20 in the longitudinal direction or flexing of the design panel 20 is prevented, and thus, it is possible to obtain the air-conditioning apparatus indoor unit 100 having high exterior design quality.

Although the thickness of the design panel may be increased to improve the rigidity of the design panel 20, it will increase the weight of the design panel 20. Because the design panel 20 is a part that is touched by a user who opens or closes it when cleaning the prefilter of the indoor unit 100 or in similar circumstances, an increase in the weight thereof needs to be avoided, from the standpoint of safety and ease of operation. In this light, in the indoor unit 100 according to Embodiment 1, because the reinforcement member 30 that has a shape extending in the longitudinal direction of the design panel 20 and is formed of a material having a higher rigidity than plastic is fixed to the design panel 20, it is possible to supplement the rigidity of the design panel 20 and to prevent warping, without increasing the thickness of the design panel 20.

The above-described embodiment is a preferred example of an air-conditioning apparatus indoor unit, and the technical scope of the present invention is not limited to this embodiment. For example, although an example case where the front panel part 21 has two panel-side restricting-and-fixing claws 21*a* and the flange part 22 has two flange-side restricting-and-fixing claws 22*a* has been described above, the configuration is not limited thereto. Specifically, the design panel 20 may be configured such that the front panel part 21 has two panel-side restricting-and-fixing claws 21*a* and the flange part 22 has at least one flange-side fixing claw 22*b*. Furthermore, the design panel 20 may be configured such that the front panel part 21 has at least one panel-side fixing claw 21*b* and the flange part 22 has two flange-side restricting-and-fixing claws 22*a*. In addition, the panel-side restricting-and-fixing claw 21*a* may be divided into a fixing claw for supporting the edge 33 and a fixing claw for supporting the one transverse end face of the reinforcement member 30, and the flange-side restricting-and-fixing claw 22*a* may be divided into a fixing claw for supporting the edge 34 and a fixing claw for supporting the other transverse end face of the reinforcement member 30. Also by employing this configuration, positioning and fixing of the reinforcement member 30 to the design panel 20 can be smoothly performed.

Moreover, although FIGS. 7 and 8 show an example in which the one-end touch-preventing wall 27 and the other-end touch-preventing wall 28 are formed so as to connect the panel-side restricting-and-fixing claw 21*a* and the flange-side restricting-and-fixing claw 22*a*, the configuration is not limited thereto. Specifically, the one-end touch-preventing wall 27 or the other-end touch-preventing wall 28 and at least one of the panel-side restricting-and-fixing claw 21*a* and the flange-side restricting-and-fixing claw 22*a* may be formed a predetermined distance away from each other.

Furthermore, the reinforcement member 30 may be formed of a thin plate-like member that extends in the longitudinal direction across the middle part of the front panel part 21 and is to be in contact with the back surface of the front panel part 21 and a thin plate-like member that extends in the longitudinal direction across the middle part of the flange part 22 and is to be in contact with the back surface of the flange part 22. In addition, the reinforcement member 30 may be formed of a member having a shape extending in the longitudinal direction across the middle part of the front panel part 21, a member having a shape extending in the longitudinal direction at one end of the front panel part 21 and a member having a shape extending in the longitudinal direction at the other end of the front panel part 21. That is, the reinforcement member 30 may be divided into a plurality of sections as long as it has rigidity enough to prevent warping of the design panel 20.

Moreover, although an example case where stainless steel is used as the material of the reinforcement member 30 has been shown in Embodiment 1, other materials may be employed as long as they have rigidity enough to prevent warping of the design panel 20 and resist rusting. Specifically, for example, stainless steel alloy, coated steel plate, or the like may be selected as the material of the reinforcement member 30. The thickness of the material to be used as the reinforcement member 30 may be changed as appropriate according to the size or the like of the design panel 20.

Furthermore, although the reinforcement member 30 formed in an L shape in section has been shown as an example in Embodiment 1, the configuration is not limited thereto, and the reinforcement member 30 may have other sectional shapes as long as it is in contact with the back surface of the front panel part 21 and the inner surface of the flange part 22. Specifically, the reinforcement member 30 may be configured to have a sectional shape that is entirely or partially curved, and it does not need to have a bent portion between the portion in contact with the back surface of the front panel part 21 and the portion in contact with the inner surface of the flange part 22. Moreover, although an example in which at least one of the edge 33 on the front panel part 21 side and the edge 34 on the flange part 22 side is subjected to contact-bending processing has been described above, the configuration is not limited thereto, and the reinforcement member 30 may be formed without the contact-bending processing. Note that the design panel 20 and the reinforcement member 30 may be formed integrally by preliminarily inserting the reinforcement member 30 into a mold for forming the design panel 20 and then injecting plastic into the mold.

In addition, in Embodiment 1, the longitudinal direction is the left-right direction in front view, and the flange part is formed at the lower longitudinal edge of the front panel part 21. Specifically, although the above-described drawings show, as an example, the indoor unit 100 and the design panel 20 that have horizontally long rectangular shapes in front view, the configuration is not limited thereto, and they may have vertically long rectangular shapes. Furthermore, although the above-described drawings show an example case where the design panel 20 is pivotable about the upper part, which is located on the positive side of the z-axis, and has the plurality of engaging projections 24 at the lower part, the configuration is not limited thereto, and the design panel 20 may be pivoted about the lower part and have the plurality of engaging projections 24 at the upper part.

REFERENCE SIGNS LIST

10 base 11 air inlet 12 air outlet 13 pivot support part 14 engaging-projection receiving part 20 design panel 21 front panel part 21*a* panel-side restricting-and-fixing claw 21*b* panel-side fixing claw 22 flange part 22*a* flange-side restricting-and-fixing claw 22*b* flange-side fixing claw 23 shaft 24 engaging projection 25 groove part 26 slope part 27 one-end touch-preventing wall 28 the other-end touch-preventing wall 30 reinforcement member 31 one end 32 the other end 33 and 34 edge 33*a* and 34*a* end face 35 space 40 wind-direction adjusting plate 50 propeller fan 60 fan motor 70 bell mouth 80 filter assembly 90 heat exchanger 100 indoor unit

The invention claimed is:

1. An indoor unit for an air-conditioning apparatus, comprising:

a design panel that pivots about an upper part to open and close, the design panel having a substantially planar shape defined by a front surface and a back surface opposite thereto; and a reinforcement plate fixed to a lower part of the back surface of the design panel, wherein the design panel includes on the front surface, a substantially planar front panel part having a rectangular shape in front view and having a flat back surface opposite thereto, and a flange part projecting from a lower longitudinal edge of the flat back surface of the front panel part, and wherein the reinforcement plate has a shape extending in a longitudinal direction of the front panel part across a middle part of the design panel and is fixed to the design panel so as to be in contact with the flat back surface of the front panel part and the flange part.

2. The indoor unit for the air-conditioning apparatus of claim 1, wherein the front panel part has, on the back surface thereof, at least two panel-side restricting-and-fixing claws that support one end and an other end of the reinforcement plate and restrict a position of the reinforcement plate, and the flange part has, on the inner surface thereof, at least one flange-side fixing claw that supports a flange-part-side edge of the reinforcement plate.

3. The indoor unit for the air-conditioning apparatus of claim 1, wherein the front panel part has, on the back surface thereof, at least one panel-side fixing claw that supports a front-panel-part-side edge of the reinforcement plate, and the flange part has, on the inner surface thereof, at least two flange-side restricting-and-fixing claws that support one end and an other end of the reinforcement plate and restrict a position of the reinforcement plate.

4. The indoor unit for the air-conditioning apparatus of claim 1, wherein the front panel part has, on the back surface thereof, two panel-side restricting-and-fixing claws that support one end and an other end of the reinforcement plate and restrict a position of the reinforcement plate, and the flange part has, on the inner surface thereof, at least two flange-side restricting-and-fixing claws that support the one end and the other end of the reinforcement plate and restrict the position of the reinforcement plate.

5. The indoor unit for the air-conditioning apparatus of claim 4, wherein the front panel part has, on the back surface thereof, at least one panel-side fixing claw that supports a front-panel-part-side edge of the reinforcement plate, and the flange part has, on the inner surface thereof, at least one flange-side fixing claw that supports a flange-part-side edge of the reinforcement plate.

6. The indoor unit for the air-conditioning apparatus of claim 1, wherein the design panel has two touch-preventing walls at positions adjacent to an one end and an other end of the reinforcement plate so as to project and extend over the back surface of the front panel part and the inner surface of the flange part.

7. The indoor unit for the air-conditioning apparatus of claim 4, wherein the design panel includes a one-end touch-preventing wall that connects the panel-side restricting-and-fixing claw and the flange-side restricting-and-fixing claw at the one end of the reinforcement plate and projects from the back surface of the front panel part and the inner surface of the flange part, and an other-end touch-preventing wall that connects the panel-side restricting-and-fixing claw and the flange-side restricting-and-fixing claw at the other end of the reinforcement plate and projects from the back surface of the front panel part and the inner surface of the flange part.

8. The indoor unit for the air-conditioning apparatus of claim 1, wherein the reinforcement plate is made of metal, and at least one of a front-panel-part-side edge and a flange-part-side edge thereof is subjected to bending.

9. The indoor unit for the air-conditioning apparatus of claim 1, wherein the reinforcement plate is formed so as to have an L shape in section according to an angle formed between the back surface of the front panel part and the inner surface of the flange part.

10. The indoor unit for the air-conditioning apparatus of claim 1, wherein the design panel is provided with, in at least one of the back surface of the front panel part and the inner surface of the flange part, a recessed groove part that accommodates at least a portion of the reinforcement plate.

11. The indoor unit for the air-conditioning apparatus of claim 1, wherein a longitudinal length of the reinforcement plate is 70% or more of a longitudinal length of the front panel part.

12. The indoor unit for the air-conditioning apparatus of claim 1, wherein the longitudinal direction of the front panel part is a left-right direction of the front panel part.

* * * * *